US009889053B2

(12) United States Patent
Caskey

(10) Patent No.: US 9,889,053 B2
(45) Date of Patent: Feb. 13, 2018

(54) METHOD FOR RESCUE AND RECOVERY OF INCAPACITATED PERSONS

(71) Applicant: Wesley Wyatt Caskey, Austin, TN (US)

(72) Inventor: Wesley Wyatt Caskey, Austin, TN (US)

( * ) Notice: Subject to any disclaimer, the term of this patent is extended or adjusted under 35 U.S.C. 154(b) by 232 days.

(21) Appl. No.: 14/968,646

(22) Filed: Dec. 14, 2015

(65) Prior Publication Data

US 2016/0136017 A1 May 19, 2016

Related U.S. Application Data

(62) Division of application No. 12/082,826, filed on Apr. 15, 2008, now Pat. No. 9,241,849.

(60) Provisional application No. 60/923,694, filed on Apr. 16, 2007.

(51) Int. Cl.

| | |
|---|---|
| ***A61G 5/00*** | (2006.01) |
| ***A61G 7/053*** | (2006.01) |
| ***A61G 1/02*** | (2006.01) |
| ***A61G 1/048*** | (2006.01) |
| ***A62B 3/00*** | (2006.01) |
| *A61G 1/00* | (2006.01) |
| *A61G 1/044* | (2006.01) |

(52) U.S. Cl.

CPC ..... *A61G 1/02* (2013.01); *A61G 1/0212* (2013.01); *A61G 1/0268* (2013.01); *A61G 1/048* (2013.01); *A62B 3/00* (2013.01); *A61G 1/00* (2013.01); *A61G 1/044* (2013.01)

(58) Field of Classification Search

CPC ..... A61G 1/02; A61G 1/0212; A61G 1/0268; A61G 1/048; A61G 1/00; A61G 1/044; A62B 3/00

USPC ..... 5/86.1, 626, 627, 625, 620; 280/646, 39; 296/20

See application file for complete search history.

(56) References Cited

U.S. PATENT DOCUMENTS

| | | | | | |
|---|---|---|---|---|---|
| 2,982,392 | A * | 5/1961 | Bossone | B60K 15/06 | 206/229 |
| 4,579,381 | A * | 4/1986 | Williams | A61G 1/0562 | 296/20 |
| 4,844,000 | A * | 7/1989 | Clement | A62B 3/00 | 116/205 |
| D345,519 | S * | 3/1994 | Clement | D10/109.1 | |
| 5,623,890 | A * | 4/1997 | Lenske | A62B 3/00 | 116/205 |
| 6,766,761 | B1 * | 7/2004 | Tamez, Jr. | A62B 3/00 | 116/205 |
| 7,942,544 | B2 * | 5/2011 | Smathers | F21V 33/0076 | 340/626 |
| 9,241,849 | B1 * | 1/2016 | Caskey | A61G 1/02 | |
| 2007/0063512 | A1 * | 3/2007 | Tamez, Jr. | F16L 19/02 | 285/354 |
| 2007/0113344 | A1 * | 5/2007 | Hurwitz | A61G 7/05 | 5/620 |

(Continued)

*Primary Examiner* — David E Sosnowski

(57) ABSTRACT

A method for a two person rescue team to rescue an incapacitated person from a hazardous environment includes a wheeled platform with a contoured recess shaped to accommodate an air pack. The platform is sufficiently low to the ground so that a transported person, as well as the rescue personnel can be kept below the heat in an inflamed building. The platform straddles a water hose which is used as an escape path by the rescue team to extract the incapacitated person.

5 Claims, 7 Drawing Sheets

(56) References Cited

U.S. PATENT DOCUMENTS

| | | | | |
|---|---|---|---|---|
| 2008/0155751 | A1* | 7/2008 | Thompson | A61G 1/00 5/626 |
| 2014/0076229 | A1* | 3/2014 | Thomas | A62B 3/00 116/205 |
| 2015/0130205 | A1* | 5/2015 | Caskey | A61G 1/04 296/20 |

* cited by examiner

METHOD FOR RESCUE AND RECOVERY OF INCAPACITATED PERSONS

CROSS REFERENCE TO RELATED APPLICATIONS

This application is a Divisional of Regular U.S. application Ser. No. 12/082,826 filed Apr. 15, 2008, which claims the benefit of U.S. Provisional Application No. 60/923,694 filed Apr. 16, 2007.

BACKGROUND OF THE INVENTION

The present invention relates broadly to a method of rescue and recovery of incapacitated personnel and especially downed fire lighting personnel in structures that are deemed immediately dangerous to life or health (IDLH). Structures designated IDLH pose a danger to second responders such as so-called Rapid Intervention Crews, or Rapid Intervention Teams, hereafter referred to as (RIC/RIT), as they are normally fatigued prior to reaching the incapacitated person. Speed in removal of the incapacitated person is critical as blazes may quickly reach flash point. Keeping the incapacitated person and the RIC/RIT below the so-called thermal layer which is a heat gradient that may vary by more than 1000 F from the floor to a height of only three feet is essential. Lack of visibility is a critical factor in most blazes and it is essential that the RIC/RIT keep all equipment on their person to avoid misplacing it. Additionally, it is well understood that the fire hose is the lifeline for the rescue personnel and following it is critical to exiting the structure. according to the U.S. Department of Labor, many states have adopted OSHA'S new Respiratory Protection Standard called "two-in two-out" policy. Many other states such as Texas, which do not fall under OSHA, have codified the policy in state law. The policy requires that two firefighters enter structures with atmospheres that are deemed IDLH. One common carry used to remove injured personnel is the two firefighter carry where one rescuer holds the incapacitated persons legs and the other supports the torso while lifting the injured person to safety. A disadvantage of this type of carry is that it places the firefighters above the thermal layer. Another carry is the so-called firefighter drag where the rescuers drag the person to safety while keeping the firefighters below the thermal layer. The drag carry is much more physically demanding than the two firefighter carry because rescuers carry in excess of 50 additional pounds in the form of protective gear.

What is needed is a means for extricating injured personnel while allowing the rescue crew to stay below the thermal layer and minimizing the amount of straining required to move an injured person.

SUMMARY OF THE INVENTION

The present invention is meant to assist these second responders in the rescue of incapacitated personnel in the IDLH atmosphere. Nowhere in the art is found an apparatus suited for the demands of this type of rescue and recovery. The apparatus is lightweight being fashioned from either heat resistant plastics, resins or aluminum alloy, and is low to the ground so as to keep the incapacitated person and the RIC/RIT below the thermal layer. The apparatus may be fitted to the back of a RIC/RIT member, over the air pack and worn or carried into a structure. Once the incapacitated person is located, the apparatus may be removed from the team member's air pack and fitted to the incapacitated person's air pack where they are then lowered into a supine position atop the apparatus allowing them to continue using their air supply while being transported. Fitting the apparatus is easily accomplished whether the injured are brought to a sitting position, on their stomach or side with the sitting position being most preferred.

The preferred means of exiting the structure is accomplished by following the water hose over which the platform is rolled having sufficient clearance to straddle the hose. Because the hose is connected to a water supply outside of the hazardous environment, it can be followed to an exit even in low visibility situations. It also makes it possible for a second team to locate the first team if there is trouble.

Although primarily designed with fire personnel in mind, conceivably, the apparatus may also be used for the rescue of miners and others in confined locations. A cable may be attached to the apparatus and the incapacitated person winched out of a confined location such as with a low ceiling. It is also conceivable that the present invention may be paired with electrical drives and servos and be piloted by remote radio control and GPS (not shown).

The apparatus is a wheeled platform having a contoured opening in the body of the apparatus desired to cradle or accept an air tank and allowing its passage along with the associated air gauges and air hoses. This allows the incapacitated person to retain the use of the air pack as they are being rolled out of the structure using the pressurized water hose as a guide. It takes much less effort to wheel an incapacitated person than to carry them. All members of the RIC/RIT are kept below the thermal layer owing to the low profile of the present invention. Because the apparatus is fitted to the incapacitated person, rather than having to rest the incapacitated person atop the apparatus, the risk of back injury for the RIC/RIT is reduced.

In the preferred embodiment of the present invention, a opening longitudinally positioned in a rectangular platform provides a contoured mouth for the admittance of an air pack. The opening tapers to an exit on the underside of the platform which faces the ground. The tapering provides for a snug fit around the air pack that eliminates lateral and longitudinal movement of the injured person. The specific contour of the opening depends on the particular air tank employed. The platform is fitted with wheeled assemblies that straddle a water hose and allow the platform to follow the water line out of the IDLH environment. Preferably the wheeled assemblies would allow the wheels to collapse for storage, although conceivably they may be fixed in an extended position. Although the platform is configured to straddle a water line, it is conceivable that an obstruction atop the hose may make it necessary to temporarily roll the wheels of the platform to the side of the hose, while still using the hose as a guide to exit the hazardous environment.

In an alternate embodiment, the longitudinally positioned opening is rectangular in shape and opens to a recess formed into the body of the apparatus to the bottom of which have been affixed laterally bowed spring clamps to grip the air tank.

As will be appreciated by those skilled in the art, lightweight materials such as molded resin, fiber-glass, carbon fiber or aluminum are suitable for platform construction.

One object of the present invention is to provide a means for the safe transport of an incapacitated personnel out of a structure designated IDLH by following the life line or water line out of the building.

Another object of the present invention is to provide a means for transport of an incapacitated personnel out of a structure designated IDLH, while keeping both the rescue personnel and the transported person below the thermal layer.

Another object of the present invention is to allow the transported person to continue to use their air pack while being moved to safety.

Still another object of the present invention is to provide a lightweight unit having a low profile design that may be either carried by or worn by rescuers into a structure designated IDLH.

Yet another object of the present invention is reduce the risk of back injury for rescue personnel by permitting the fitting of the present invention to the back of an incapacitated person thus obviating the need for living.

The description as follows is not intended to limit the scope of the invention to the particular forms set forth, but on the contrary, it is intended to cover such alternatives, modifications, and equivalents as may be included within the spirit and scope of the invention as deemed by the appended claims.

DETAILED DESCRIPTION OF THE EMBODIMENTS

Reference Listing

Figure 1:
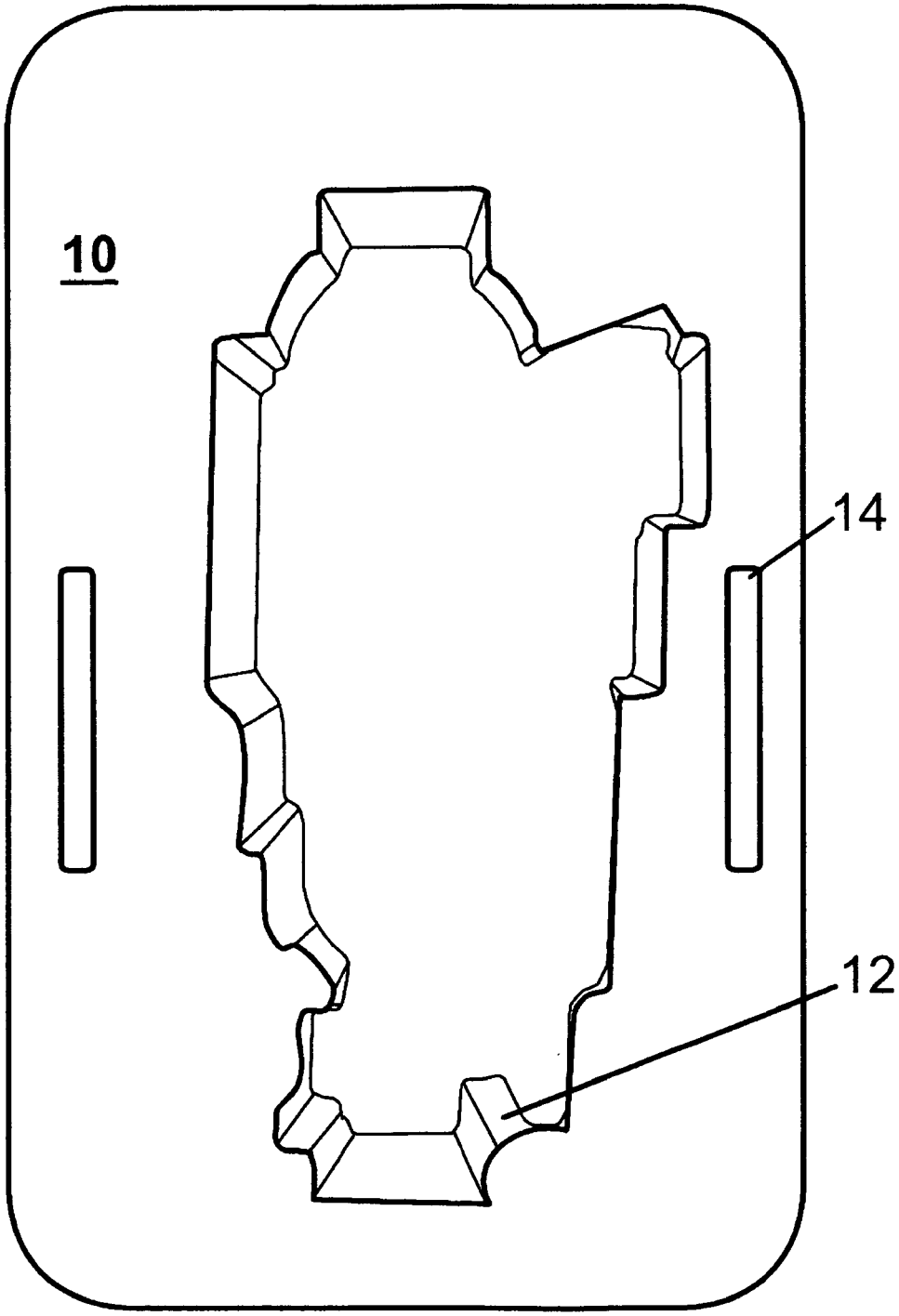
FIG. 1 shows a top plan view of the platform with a contoured and tapering recess for the acceptance of an air tank.

10 platform
12 contoured opening
14 side slits
18 safety belt
20 collapsible wheel assemblies
21 spring clamps
24 fork
26 U-bracket
28 pivoting cam
32 stay
33 shaft
34 water hose Definitions IDLH designates an environment that is immediately dangerous to life or health. Thermal layer refers to the tendency of gasses to form in layers according to temperatures of up to 1200 F and under which fire fighting personnel attempt to operate. The term "platform" refers to a body of light weight and heat resistant material that may be formed by thermoforming methods, vacuum forming or molding or stamping. The terms "rigid light weight heat-resistant material" refers generally to those materials comprised of resin and fiber such as fiber glass as well as carbon fiber. Not excluded in this definition would be those thermoplastics used in vacuum forming such as KYDEX® GND thermoplastic alloy sheet or aluminum alloys. The term "laterally bowed spring clamp" refer to a class of generally U-shaped clamps where a cylindrical object is secured by pressing the object between the arms of the spring clamp whereby the arms are forced apart to allow the object to seat and thus inhibiting lateral movement of the seated cylindrical object. The term "air pack" refers to any of the SCBA (self contained breathing apparatus) or CCBA (closed circuit breathing apparatus) used by rescue works and firefighters and manufactured by Scott Health and Safety, MSA and others. Unless otherwise explained, any technical terms used herein have the same meaning as commonly understood by one of ordinary skill in the art to which this disclosure belongs. The singular terms "a," "an," and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. The term "comprises" means "includes." Publications, patent applications, patents, and other references mentioned herein, if any, are incorporated by reference in their entirety for all purposes. In case of conflict, the instant specification, including explanations of terms, will control. In addition, the materials, methods, and examples are illustrative only and not intended to be limiting.

Figure 3:
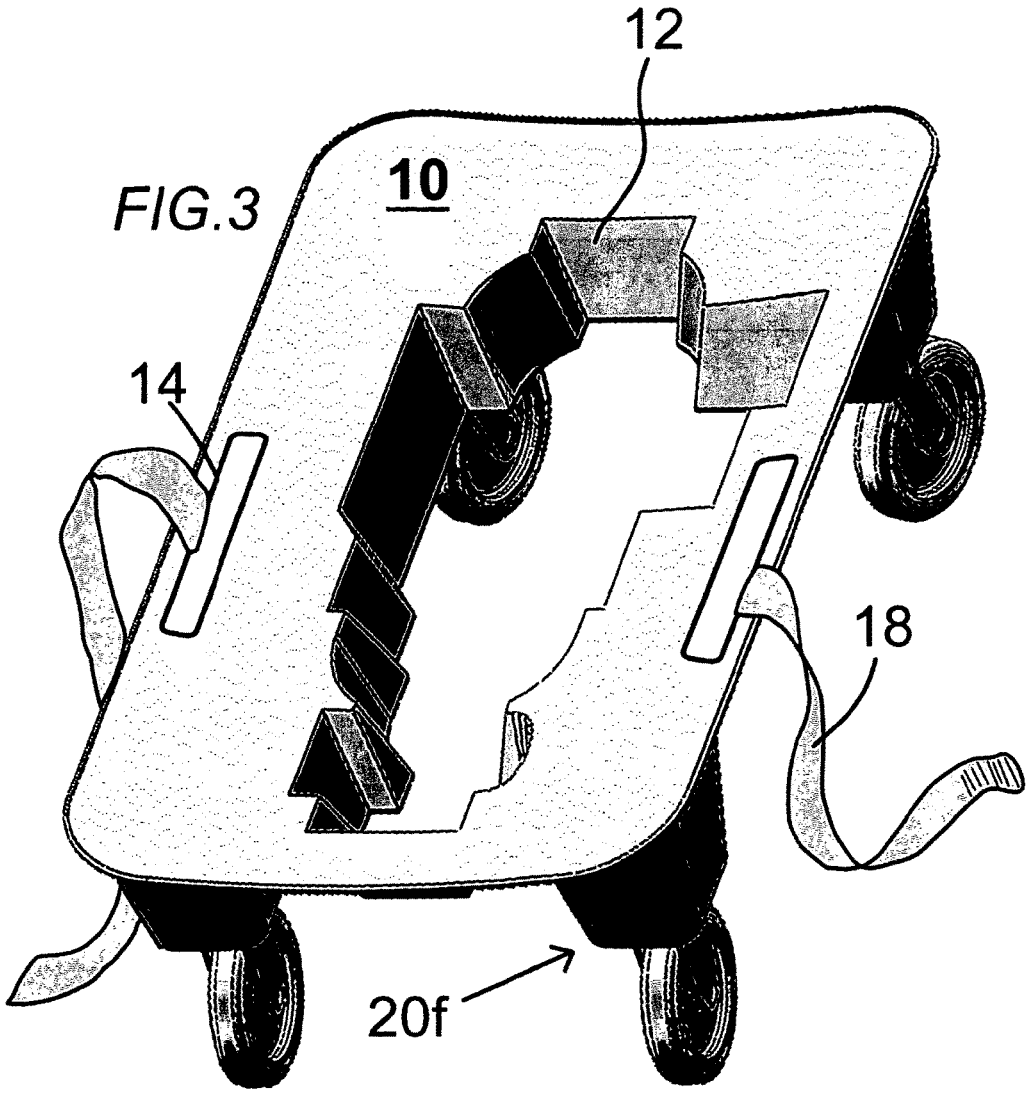
FIG. 3 shows a perspective view of one embodiment according to the present invention with non-folding wheels.

FIG. 1 is a top view of a preferred embodiment of the present invention including platform 10, a contoured tapered opening 12 and side slits 14 for hand holds or attachment of safety belts 18 (FIG. 3). The platform is preferably constructed of a rigid light weight heat-resistant material such as vacuum formed thermoplastic, carbon fiber or aluminum alloy, though a wide range of materials such as wood laminate may be used. Methods of manufacture conceived for the platform are common and well understood in the art and may consist of additive processes such a layered fiber glass and resin compositions, pour molding and injection molding.

Fire and rescue departments tend to be standardized as to types of air packs employed, there being some variety on the market such as MSA, Scott air packs ad others. Because forms of the various air packs vary with the manufacturer a fire rescue team would select the appropriate contoured opening to match their equipment. Although the tapered opening 12 shown in FIG. 1 is designed to fit around a Scott® air pack, some of the newer CCBA air packs are substantially rectangular and it follows that the opening could take that shape or any other as required. Tapered contours for a particular make and model of air pack are obtained at design time by taking measurements of the air pack with associated hoses and connectors while being worn. Allowances are made for movement of the various elements so that the air pack is funneled into a stable position when the platform opening is placed over it.

Figure 2:
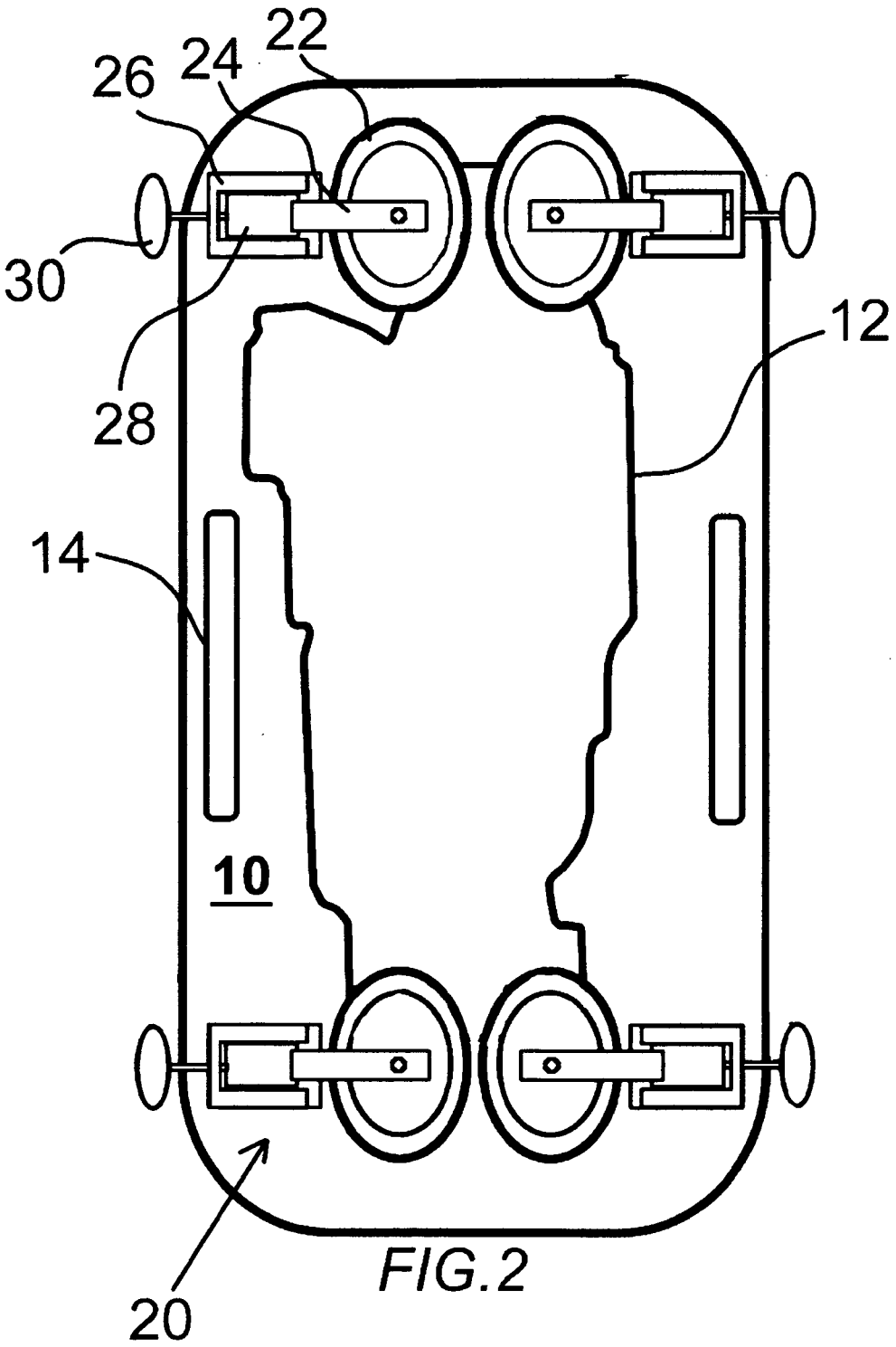
FIG. 2 shows a plan view of the bottom of the platform with wheels in collapsed position.
Figure 9:
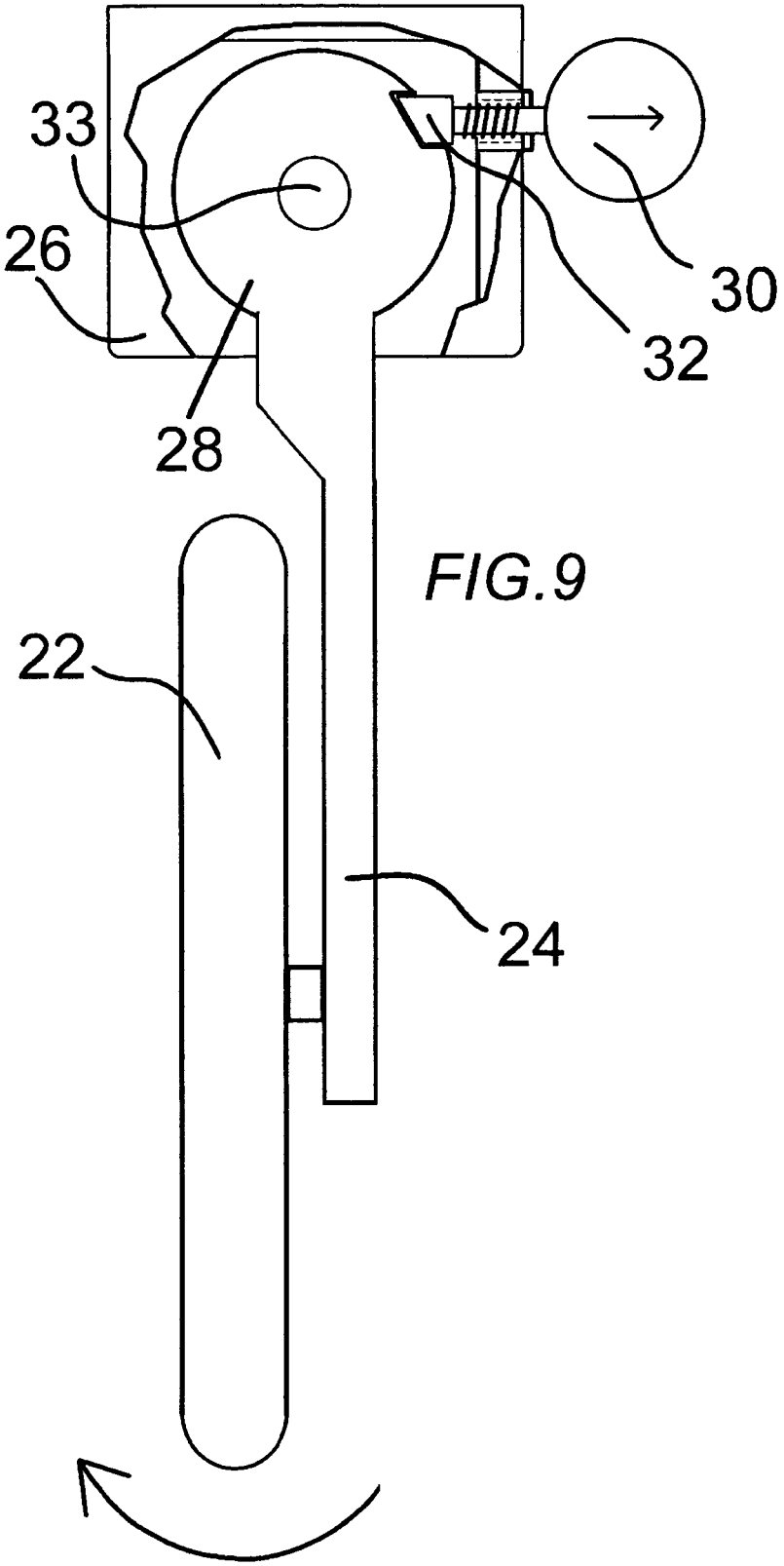
FIG. 9 shows a detail view of a collapsible wheel assembly with bracket 26 partially cutaway.

FIG. 2 shows the underside of the platform with wheels in collapsed position, important for storage on rescue vehicles with little available space. While collapsible wheel assemblies 20 are preferred, axed wheel assemblies off such as shown in FIG. 3 will operate effectively and may offer some cost advantages in manufacture. One non-limiting example of a collapsible wheeled assembly is shown in FIG. 9, in which a cutaway view shows a single fork 24 and pivot cam 28 affixed by shaft 33 within a U-bracket 26 wherein pivoting cam 28 is releasably lockable in an extended position, wheels outward, by means of a spring tensioned stay 32 slid into a recess in the pivot cam preventing movement; and collapsed by pulling knob 30 removing the stay from the recess and folding the fork and wheel 24, 22 inward toward the platform. Another possibility (not shown) is that of wheels with independent suspension such as are used in some off-road vehicles or all terrain vehicles (ATV).

Figure 4:
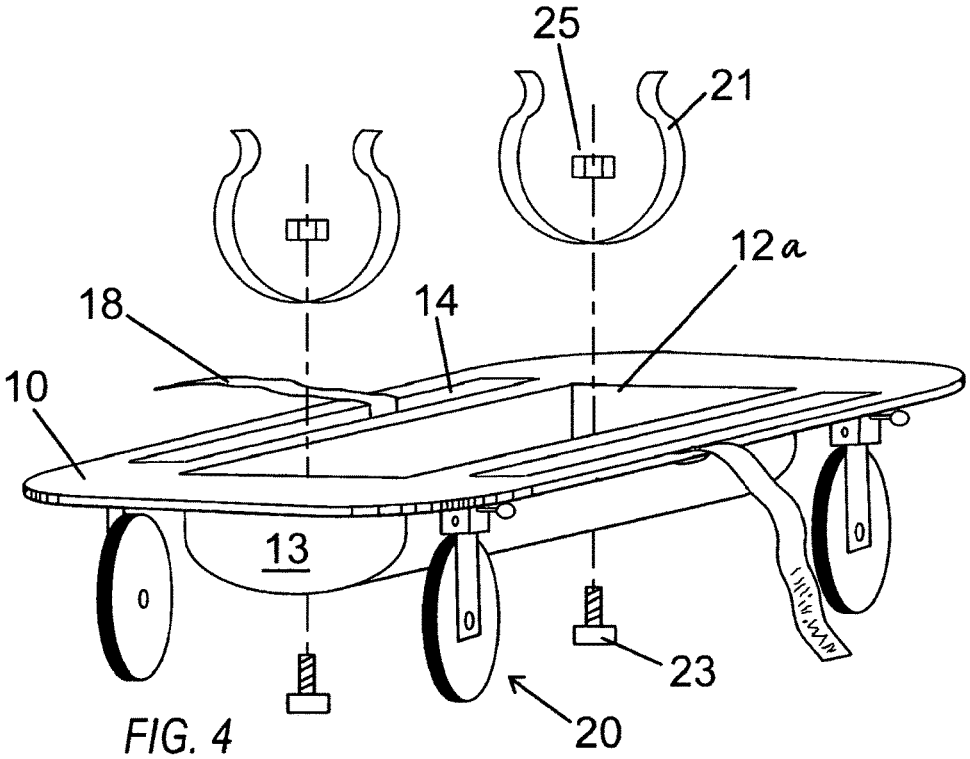
FIG. 4 shows a perspective view of another embodiment according to the present invention having an enclosed recess with brackets set therein.
Figure 5:
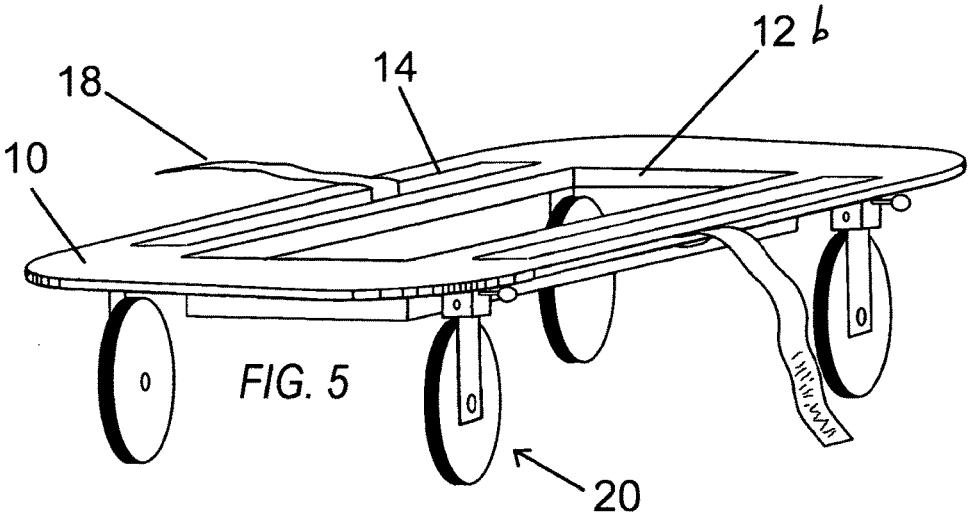
FIG. 5 shows a perspective view of another embodiment with a rectangular recess.
Figure 6:
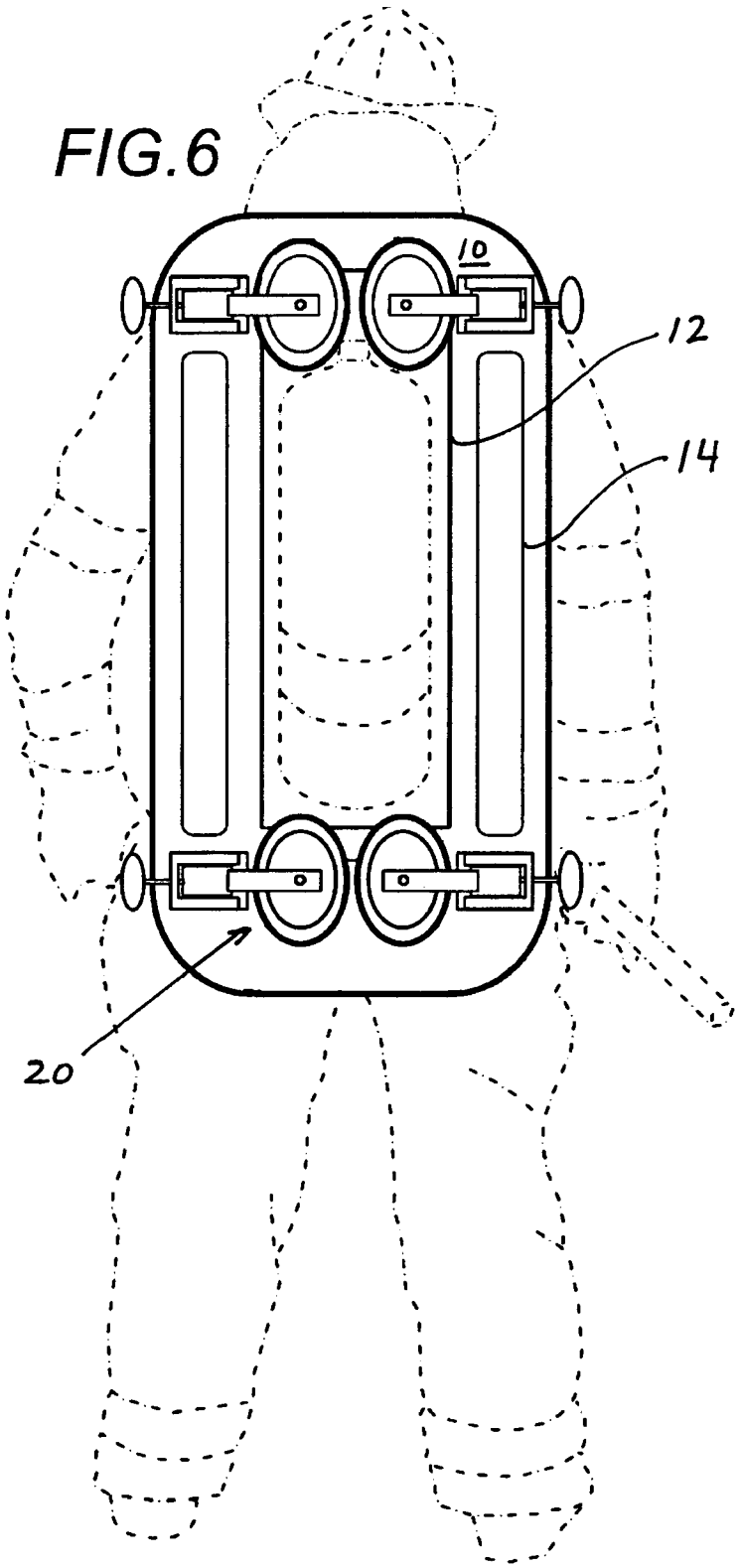
FIG. 6 shows a preferred embodiment according to the present invention attached to the air tank of a rescue team member.

FIG. 4 shows an alternate embodiment of the platform according to the present invention with a rectangular opening. An enclosed recess can be used with some of the older air packs with larger air tanks. Recess 12*a* in the body of the platform 10 receives the air tank and laterally bowed spring clamps 21 affixed to the bottom of the recess secure the air tank. Although the means to attach the spring clamps is shown as a nut and bolt 25, 23, the clamps can be molded into the recess, or the recess molded to assume an arcuate shape similar to the spring clamps to receive an air tank without affecting the function. FIG. 5 shows a rectangular opening 12*b* with an exit that would be suitable for some recent modular CCBA'S that are rectangular in shape.

Figure 7:
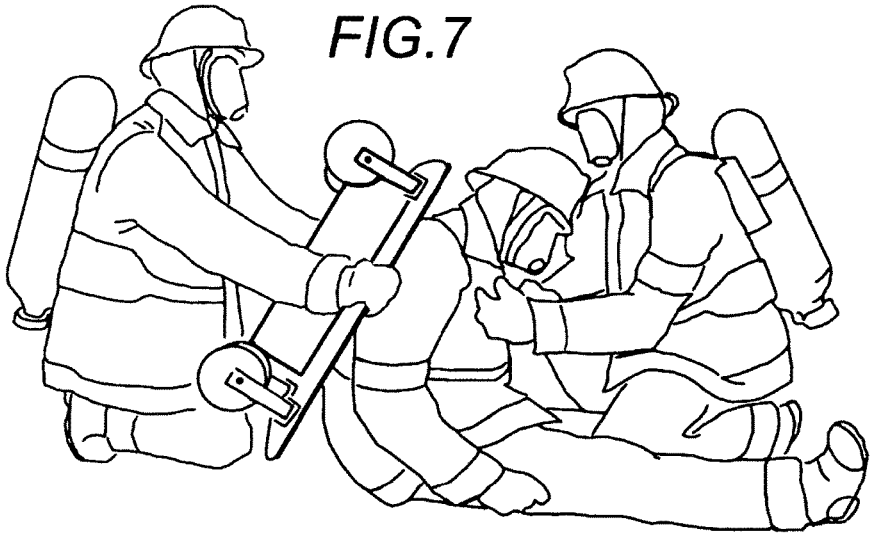
FIG. 7 shows a preferred embodiment according to the present invention wherein a rescue teem is positioning the platform over and around the air pack of a downed firefighter.
Figure 8:
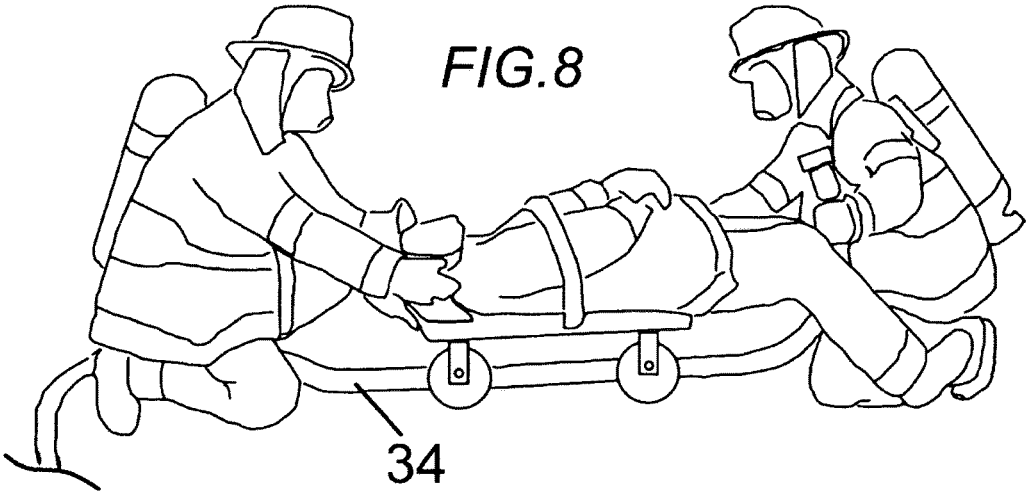
FIG. 8 illustrates the downed firefighter placed in supine position atop the present invention in which the wheels of the platform are shown straddling a water hose 34 connected to a water source outside of the IDLH.

FIGS. 7-8 show the apparatus being fitted respectively, to the back of a downed firefighter encompassing the air pack. The downed firefighter is lowered into a supine position atop the platform. The water hose 34 is shown preferentially running under and between the wheels so that the rescue personnel can use it as a guide to exiting the IDLH environment.

In view of the many possible embodiments to which the principles of the disclosed invention may be applied, it should be recognized that the illustrated embodiments are only preferred examples of the invention and should not be taken as limiting the scope of the invention. Therefore, this disclosure is intended to cover such alternatives, modifications, and equivalents as may be included in the spirit and scope of the description in view of the appended drawings and claims.

What is claimed is:

1. A method of rescue and recovery of incapacitated persons from a hazardous space comprising the steps of:

providing a lightweight wheeled platform capable of supporting a person, including:

a plurality of wheel assemblies for rolling on the ground;

a top surface encircling a longitudinally positioned opening contoured to restrict admittance to an air pack and permit passage therethrough, and wherein the opening tapers to an exit in the direction of the ground when the wheels of the platform are in contact with the ground, and wherein ground clearance of the platform is sufficient to straddle a firefighter's expanded water line;

transporting of the platform to an incapacitated person within a hazardous space;

moving the incapacitated person into a position suitable to receive and retain the platform, and fitting the opening to the incapacitated person's back, and around an air pack if one is present;

moving the platform with the incapacitated person into a horizontal disposition with the wheel assemblies in contact with the ground; and, rolling the incapacitated person out of the hazardous space along a predetermined path to an exit wherein the predetermined path includes a firefighter's water line maintained adjacent the wheels of the platform when exiting.

2. The method according to claim 1 wherein the wheeled platform straddles the water line when exiting along the predetermined path.

3. The method according to claim 1 wherein the top surface of the platform is curved at the periphery to cup a human torso.

4. A method of rescue and recovery of incapacitated persons from a hazardous space comprising the steps of:

providing a lightweight wheeled platform capable of supporting an incapacitated person, including:

a plurality of wheel assemblies for rolling on the ground;

a substantially rectangular top surface with a longitudinally positioned opening encircled by the top surface and contoured to restrict admittance to an air pack therethrough, wherein ground clearance of the platform is sufficient to straddle a firefighter's expanded water line, and wherein the top surface of the platform is curved at the periphery to cup a human torso;

a fastening means to securely retain the incapacitated person in a supine position atop the platform;

transporting the platform to an incapacitated person within a hazardous space;

moving the incapacitated person into a position suitable to receive and retain the platform, and fitting the opening to the incapacitated person's back, and around an air pack if one is present;

moving the platform with the incapacitated person into a horizontal disposition with the wheel assemblies in contact with the ground; and, rolling the incapacitated person out of the hazardous space along a predetermined path to an exit wherein the predetermined path includes a firefighter's water line maintained adjacent the wheels of the platform when exiting.

5. The method according to claim 4 wherein the wheeled platform straddles the water line when exiting along the predetermined path.

* * * * *